US007965305B2

(12) United States Patent
Miller et al.

(10) Patent No.: US 7,965,305 B2
(45) Date of Patent: Jun. 21, 2011

(54) COLOR DISPLAY SYSTEM WITH IMPROVED APPARENT RESOLUTION

(75) Inventors: Michael E. Miller, Honeoye Falls, NY (US); Ronald S. Cok, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 1062 days.

(21) Appl. No.: 11/429,838

(22) Filed: May 8, 2006

(65) Prior Publication Data

US 2007/0257944 A1 Nov. 8, 2007

(51) Int. Cl.
*G09G 5/02* (2006.01)

(52) U.S. Cl. ..... 345/694; 345/76; 345/77; 345/581; 345/589; 345/613

(58) Field of Classification Search ..... 345/76–77, 345/82–84, 36, 39, 45–46, 428, 581, 589–591, 345/593, 606, 611–613, 643–644
See application file for complete search history.

(56) References Cited

U.S. PATENT DOCUMENTS

| | | | | |
|---|---|---|---|---|
| 3,971,065 | A | 7/1976 | Bayer | |
| 5,113,274 | A | 5/1992 | Takahashi et al. | |
| 5,793,885 | A | 8/1998 | Kasson | |
| 5,987,169 | A | 11/1999 | Daly et al. | |
| 6,151,025 | A * | 11/2000 | Yen et al. | 345/418 |

(Continued)

FOREIGN PATENT DOCUMENTS

WO WO03/100756 12/2003

(Continued)

OTHER PUBLICATIONS

U.S. Appl. No. 11/429,884, filed May 8, 2006; of Michael E. Miller, Ronald S. Cok, Paul J. Kane, Michael J. Murdoch; titled "Color Display System With Improved Apparent Resolution".

(Continued)

*Primary Examiner* — Jason M Mandeville
(74) *Attorney, Agent, or Firm* — Morgan, Lewis & Bockius LLP

(57) ABSTRACT

A full color display system comprised of: a) a display which is formed from a two-dimensional array of three or more differently colored light-emitting elements arranged in a repeating pattern forming a first number of full-color two-dimensional groups of light-emitting elements, each full-color group of light-emitting elements being formed by more than one luma-chroma sub-group of light-emitting elements, wherein the display has a peak white luminance and each luma-chroma sub-group comprising at least one distinct high-luminance light-emitting element having a peak output luminance value that is 40 percent or greater of the peak white luminance of the display device; and b) a processor for providing a signal to drive the display by receiving a three-or-more color input image signal, which specifies three-or-more color image values at each of a two-dimensional number of sampled addressable spatial locations within an image to be displayed; wherein the processor dynamically forms re-sampling functions for image spatial locations derived from the input image signal and corresponding to the spatial location of each luma-chroma sub-group in the display array based on an analysis of the spatial content of the three-or-more color input image signal and the display array repeating pattern, and applying the re-sampling functions to the three-or-more color input image signal to render a signal for driving each light-emitting element within each corresponding luma-chroma sub-group of light-emitting elements.

18 Claims, 9 Drawing Sheets

U.S. PATENT DOCUMENTS

| | | | | |
|---|---|---|---|---|
| 6,366,025 | B1 | 4/2002 | Yamada | |
| 6,507,350 | B1 | 1/2003 | Wilson | |
| 6,664,955 | B1 * | 12/2003 | Deering | 345/418 |
| 6,771,028 | B1 | 8/2004 | Winters | |
| 6,885,380 | B1 | 4/2005 | Primerano et al. | |
| 6,897,876 | B2 | 5/2005 | Murdoch et al. | |
| 6,919,681 | B2 | 7/2005 | Cok et al. | |
| 6,956,582 | B2 * | 10/2005 | Tidwell | 345/611 |
| 7,221,381 | B2 * | 5/2007 | Brown Elliott et al. | 345/690 |
| 7,248,268 | B2 * | 7/2007 | Brown Elliott et al. | 345/613 |
| 7,598,963 | B2 * | 10/2009 | Brown Elliott et al. | 345/589 |
| 7,598,965 | B2 * | 10/2009 | Brown Elliott et al. | 345/613 |
| 7,623,141 | B2 * | 11/2009 | Brown Elliott et al. | 345/690 |
| 7,755,649 | B2 * | 7/2010 | Brown Elliott et al. | 345/690 |
| 2002/0154152 | A1 | 10/2002 | Tezuka et al. | |
| 2003/0103058 | A1 * | 6/2003 | Hellen Brown Elliott et al. | 345/589 |
| 2004/0113875 | A1 | 6/2004 | Miller et al. | |
| 2004/0263528 | A1 * | 12/2004 | Murdoch et al. | 345/600 |
| 2005/0212728 | A1 | 9/2005 | Miller et al. | |
| 2005/0225563 | A1 | 10/2005 | Brown Elliott et al. | |
| 2005/0225574 | A1 | 10/2005 | Brown Elliott et al. | |
| 2005/0225575 | A1 | 10/2005 | Brown Elliott et al. | |
| 2007/0257946 | A1 * | 11/2007 | Miller et al. | 345/694 |

FOREIGN PATENT DOCUMENTS

| | | |
|---|---|---|
| WO | WO 2005/052902 | 6/2005 |

OTHER PUBLICATIONS

U.S. Appl. No. 11/430,065, filed May 8, 2006; of Ronald S. Cok; titled "Method and Apparatus for Defect Correction in a Display".

U.S. Appl. No. 11/429,704, filed May 8, 2006; of Michael E. Miller, Michael J. Murdoch, Ronald S. Cok; titled "Method for Rendering Color EL Display and Display Device With Improved Resolution".

U.S. Appl. No. 11/429,839, filed May 8, 2006; of Michael E. Miller, Michael J. Murdoch, Ronald S. Cok; titled "Color EL Display System With Improved Resolution".

* cited by examiner

COLOR DISPLAY SYSTEM WITH IMPROVED APPARENT RESOLUTION

FIELD OF THE INVENTION

The present invention relates to full-color display systems and, more particularly, to arrangements of light-emitting elements in display devices of such color display systems and image processing for improving the apparent resolution of the display devices.

BACKGROUND OF THE INVENTION

Flat panel, color displays for displaying information, including images, text, and graphics are widely used. These displays may employ any number of known technologies, including liquid crystal light modulators, plasma emission, electro-luminescence (including organic light-emitting diodes), and field emission. Such displays include entertainment devices such as televisions, monitors for interacting with computers, and displays employed in hand-held electronic devices such as cell phones, game consoles, and personal digital assistants. In these displays, the resolution of the display is always a critical element in the performance and usefulness of the display. The resolution of the display specifies the quantity of information that can be usefully shown on the display and the quantity of information directly impacts the usefulness of the electronic devices that employ the display.

However, the term "resolution" is often used or misused to represent any number of quantities. Common misuses of the term include referring to the number of light-emitting elements or to the number of full-color groupings of light-emitting elements (typically referred to as pixels) as the "resolution" of the display. This number of light-emitting elements is more appropriately referred to as the addessability of the display. Within this document, we will use the term "addressability" to refer to the number of light-emitting elements per unit area of the display device. A more appropriate definition of resolution is to define the size of the smallest element that can be displayed with fidelity on the display. One method of measuring this quantity is to display the narrowest possible, neutral (e.g., white) horizontal or vertical line on a display and to measure the width of this line or to display an alternating array of neutral and black lines on a display and to measure the period of this alternating pattern. Note that using these definitions, as the number of light-emitting elements increases within a given display area, the addressability of the display will increase while the resolution, using this definition, generally decreases. Therefore, counter to the common use of the term "resolution", the quality of the display is generally improved as the resolution becomes finer in pitch or smaller.

The term "apparent resolution" refers to the perceived resolution of the display as viewed by the user. Although, methods for measuring the physical resolution of the display device are typically designed to correlate with apparent resolution, it is important to note that this does not always occur. At least two important conditions under which the physical measurement of the display device does not correlate with apparent resolution exist. The first of these occur when the physical resolution of the display device is small enough that the human visual system is unable to resolve changes in physical resolution (i.e., the apparent resolution of the display becomes eye-limited). The second condition occurs when the measurement of the physical resolution of the display is performed for only the luminance channel but not performed for resolution of the color information while the display actually has a different resolution within each color channel.

Addressability in most flat-panel displays, especially active-matrix displays, is limited by the need to provide signal busses and electronic control elements in the display. Further in many flat panel displays, including Liquid Crystal Displays (LCDs) and bottom-emitting Electro-Luminescent (EL) displays, the electronic control elements are required to share the area that is required for light emission or transmission. In these technologies, the more such busses and control elements that are needed, the less area in the display is available for actual light-emitting areas. Depending upon the technology, reduction of the area of the light-emitting area can reduce the efficiency of light output, as is the case for LCDs, or reduce the brightness and/or lifetime of the display device, as is the case for EL displays. Regardless of whether the area required for patterning busses and control elements competes with the light-emitting area of the display, the decrease in buss and control element size that occur with increases in addressability for a given display generally require more accurate, and therefore more complex, manufacturing processes and can result in greater number of defective panels, decreasing yield rate and increasing the cost of marketable displays. Therefore, from a cost and manufacturing complexity point of view, it is generally advantageous to be able to provide a display with lower addressability. This desire is, of course, in conflict with the need to provide higher apparent resolution. Therefore, it would be desirable to provide a display that has relatively low addessability but that also provides high apparent resolution.

It has been known for many years that the human eye is more sensitive to luminance in a scene than to color. In fact, current understanding of the visual system includes the fact that processing is performed within or near the retina of the human eye that converts the signal that is generated by the photoreceptors into a luminance signal, a red/green difference signal and a blue/yellow difference signal. Each of these three signals have different resolution as depicted by the modulation threshold curves shown in FIG. 1 for a given user population and illumination level. As shown, the luminance channel can resolve the finest detail as indicated by the fact that the modulation threshold curve for the luminance signal 2 has the highest spatial frequency cutoff, the modulation threshold for the red/green signal 4 has the second highest spatial frequency cutoff and the blue/yellow signal 6 has the lowest spatial frequency cutoff and that the cutoff for the blue/yellow signal is on the order of one fourth the cutoff for the luminance signal. It is further notable that while the human visual system is sensitive to relatively high frequency spatial information in the luminance channel, it is less sensitive to very low spatial frequency information in the luminance channel. And while the human visual system is not as sensitive to high spatial frequency in the chrominance channels as in the luminance channels, it can be quite sensitive to even very low spatial frequency in the chrominance channels.

This difference in sensitivity is well appreciated within the imaging industry and has been employed to provide lower cost systems with high perceived quality within many domains, most notably digital camera sensors and image compression and transmission algorithms. For example, since green light provides the preponderance of luminance information in typical viewing environments, digital cameras typically employ two green sensitive elements for every red and blue sensitive element and interpolate intermediate luminance values for the missing colored elements within each color plane. In typical image compression and transmission algorithms, image signals are converted to a luminance/ chrominance representation and the chrominance channels undergo significantly more compression than the luminance channel.

Similarly, this fact has been used in display devices to provide high apparent resolution for a reduced addressability. Takashi et al. in U.S. Pat. No. 5,113,274, entitled "Matrix-type color liquid crystal display device", has proposed the use of displays having two green for every red and blue light-emitting element. While such an array of light-emitting elements can perform well for displays with a very high addressability, it is important that the red light-emitting elements typically provide approximately 30 percent of the luminance. Therefore, under certain conditions, such as when displaying flat fields of red, it is possible to see artifacts (e.g., a red and black checkerboard pattern in areas that are intended to be perceived as a flat field red) that occur because of the scarcity of the red light-emitting elements within the array. Therefore, it is important to understand that in displays it is not only the size or the frequency of light-emitting elements that are important in order to understand the quality of the display device but also the space between the light-emitting elements. Therefore, the relative location of the different light-emitting elements within the array can produce displays with significantly different appearance. For example, when using arrays such as proposed by Takashi, it is very important that the position of the red and blue light-emitting elements be alternated within each pair of rows and columns of the display device as this significantly reduces the appearance of artifacts such as the checkerboard pattern. It is also appreciated in the art that by offsetting the high luminance elements within an array of light-emitting elements, the perceived artifacts may be adjusted. For example it is known to offset alternate rows of red, green, and blue light-emitting elements on low resolution pictorial displays (a pixel pattern commonly referred to as the delta pattern since pixels are formed from red, green, and blue elements that are arranged in triangles) to create a higher perceived quality display since by offsetting the high luminance green elements on successive rows, the images that are presented have a "smoother" appearance. It is also recognized, however, that these effects can be quite image content dependent and therefore, displays that are designed to present text do not offset the position of light-emitting elements within alternate rows as this pixel arrangement creates the appearance of ragged edges on high contrast vertical lines, which occur frequently in text and this ragged appearance (commonly referred to as "jaggies") can be quite disturbing to the user.

In addition to higher perceived quality, the introduction of more high luminance light-emitting elements into a display can have other positive effects. For example, within the field of Organic Light Emitting Diodes (OLEDs), it is known to introduce more than three light-emitting elements where the additional light-emitting elements have higher luminance efficiency, resulting in a display having higher luminance efficiency. Such displays have been discussed by Miller et al. in US Patent Application Publication 2004/0113875 entitled "Color OLED display with improved power efficiency" and US Patent Application Publication 2005/0212728 also entitled "Color OLED display with improved power efficiency".

This fact has been used in a variety of ways to optimize the frequency response of imaging systems. For example, relative sensitivities of the human eye to different color channels have recently been used in the liquid crystal display (LCD) art to produce displays having subpixels with broad band emission to increase perceived resolution. For example, US Patent Application 2005/0225574 and US Patent Application 2005/0225575, each entitled "Novel subpixel layouts and arrangements for high brightness displays" provide various subpixel arrangements such as the one shown in FIG. 2. FIG. 2 shows a portion of a prior art display 10 as discussed within these disclosures. Of importance in this subpixel arrangement is the existence of a high-luminance subpixel, such as the white subpixel 12 that allows more of the white light generated by the LCD backlight to be transmitted to the user than the traditional filtered RGB subpixels (14, 16, and 18) and the fact that each row in the subpixel arrangement contains all colors of subpixels, makes it possible to produce a line of any color using only one row of subpixels. Similarly, every pair of columns within the subpixel arrangement contain all colors of subpixels within the display, making it possible to produce a line of any color using only two columns of subpixels. Therefore, when the LCD is driven correctly, it can be argued that the vertical resolution of the device is equal to the height of one row of subpixels and the horizontal resolution of the device is equal to the width of two columns of subpixels, even though it realistically requires more subpixels than the two subpixels at the intersection of such horizontal and vertical lines to produce a full-color image. However, since each pair of subpixels at the junction of such horizontal and vertical lines contain at least one high luminance subpixel (typically green 16 or white 12), each pair of light-emitting elements provide a relatively accurate luminance signal within each pair of subpixels, providing a high-resolution luminance signal. It is important to note that in arrangements of light-emitting elements such as these, as well as those discussed by Takashi, there are more high-luminance light-emitting elements than there are repeating patterns of light-emitting elements that are capable of producing a full-color image. Therefore, by using arrangements of light-emitting elements such as these, it is possible to display a luminance pattern with a higher spatial frequency than would be possible if each luminance signal was to be rendered to each repeating pattern of light-emitting elements. However, to achieve this goal, a proper rendering algorithm must be provided to provide this higher resolution rendering without creating significant color artifacts.

Many input image signals may be used to encode and transmit a full-color image for display. For example, an input image may be described in common RGB color spaces such as sRGB or in luminance/chrominance spaces such as YUV, L*a*b*, or YIQ. In any case, the input display signal must be converted to a signal suitable for driving the native display light-emitting elements. This conversion may involve steps such as conversion of a three-color input image signal to a signal to drive an array of four or more colors of light-emitting elements as described in U.S. Pat. No. 6,897,876 issued May 24, 2005. This conversion may also comprise methods such as subpixel interpolation like those described in US Patent Application 2005/0225563, entitled "Subpixel rendering filters for high brightness subpixel layouts", which allows an input image signal that is intended for display on an arrangement of subpixels to be interpolated such that the input data is more appropriately matched to an alternate arrangement of subpixels. While subpixel interpolation methods known in the art allow different spatial filtering operations to be performed on signals that are intended for display on subpixels having different colors, they do not fully allow the optimization of the signal to take advantage of the difference in the human visual system's sensitivities to luminance and chrominance information. Specifically, the known subpixel interpolation techniques generally apply a static, typically even, function to the image information where this function is an averaging function that smoothes the image content. As such, the known subpixel interpolation algorithms generally blur the image content. To counter the blur introduced by such a subpixel interpolation algorithm, luminance bearing color channels must then be sharpened to boost the low frequency content in order to compensate for the lost high frequency content that occurs as a result of subpixel interpolation as discussed within this application, increasing the number of image processing steps that must be conducted or increasing the necessary size of the convolution kernel which then requires more image information to be buffered and increases the computational complexity of the process.

Pixel fault masking algorithms have also been proposed in RGBW systems as described in WO 03/100756, entitled "Pixel Fault Masking" which render information to neighboring light-emitting elements when one element is incapable of producing light due to manufacturing defects. As described in this application, these algorithms are known to consider information to be displayed by light-emitting elements that are neighbors to a faulty light-emitting element to form a weighting function in an optimization algorithm that attempts to minimize perceived error. As such these algorithms may render information to light-emitting elements that surround a faulty light-emitting element by applying a function that is dependent upon the content of the image to be displayed. However, since the formation of this rendering function requires an optimization problem to be solved, which can be quite compute intensive. Further, as it is a feature that the "problem only needs to be solved for the defect pixels" as taught therein, of which there are typically only tens of defect pixels in a display having millions of subpixels, there is no teaching of any process applicable to the rendering of a full-color image to each light-emitting element within a display.

It is known in the art to perform separate manipulations on luminance than on chrominance-encoded signals. For example, U.S. Pat. No. 5,987,169, entitled "Method for improving text resolution in images with reduced chromatic bandwidth" recognizes that some compression means provide excessive blurring to high spatial frequency, high luminance chrominance information, resulting in text or other high spatial frequency image objects that appear blurred. To overcome this problem, this patent discusses reducing the chrominance signal for highly chromatic text displayed on bright (white) backgrounds.

US Patent Application 2002/0154152, entitled "Display apparatus, display method and display apparatus controller" describes a display having red, green, and blue elements or subpixels which form full-color pixels. This display receives an input image signal, converts the signal to a luminance and chrominance signal, then renders the luminance information to the subpixel level but renders the chroma information to the pixel level, thus the luminance signal is represented at a higher spatial frequency than the chrominance signal, thereby providing a higher perceived resolution without significant lower frequency chromatic artifacts. To obtain optimal performance according to this invention, it is necessary that the input image signal address a number of spatial locations equal to the number of subpixels in the display device. However, this patent application is deficient in that because the arrangements of light-emitting elements that are discussed include only one high luminance light-emitting element per pixel, the subpixel arrangement limits the usefulness of this approach since the low luminance red and blue subpixels discussed in this patent application actually present little luminance information and therefore are incapable of rendering a significant portion of the higher addressability luminance information that is present in the input signal. Further, this patent only employs linear transforms to convert from one three-channel image representation to a second three-channel representation and as such can not be applied when converting an input three-color signal to a four-or-more output color signal. Further, the disclosure assumes that a perfect rendering can be obtained without luminance or chrominance error, while in practice some degree of luminance and/or chrominance error will often practically be present and an appropriate tradeoff must be made between these errors. Finally, the method ignores the fact that different tradeoffs between localized luminance and chrominance error may be made depending upon the spatial content of the image.

U.S. Pat. No. 5,793,885 entitled "Computationally efficient low artifact system for spatially filtering digital color images" also discusses converting an input image to a luminance and chrominance domain and then applying sharpening to only the luminance channel in the input RGB image. By applying this manipulation to the luminance channel, the image may be sharpened by applying a single convolution to the luminance channel rather than convolving each of the red, green, and blue image signals by separate sharpening kernels. Using this approach, the efficiency of the image processing system is improved. While this process sharpens the luminance channel within the image, it does not necessarily improve the reconstruction of edge information and like the previous patent application, it does not anticipate that such a method might be significantly more beneficial when provided in a display having more high luminance subpixels than pixels or when applied in a display system having not only red, green, and blue light-emitting elements, but also additional light-emitting elements such that the number of convolutions might be reduced to one fourth or even more.

There is a need, therefore, for an improved image processing method and associated arrangements of light-emitting elements for improving the apparent resolution of displays wherein the arrangement of light-emitting elements contain more high luminance light-emitting elements than pixels. Particularly, such a method should provide a means of providing a higher image quality when rendering an image to an arrangement of red, green, blue, and at least one additional light-emitting element.

SUMMARY OF THE INVENTION

In accordance with one embodiment, the present invention is directed towards a full color display system comprised of: a) a display which is formed from a two-dimensional array of three or more differently colored light-emitting elements arranged in a repeating pattern forming a first number of full-color two-dimensional groups of light-emitting elements, each full-color group of light-emitting elements being formed by more than one luma-chroma sub-group of light-emitting elements, wherein the display has a peak white luminance and each luma-chroma sub-group comprising at least one distinct high-luminance light-emitting element having a peak output luminance value that is 40 percent or greater of the peak white luminance of the display device; and b) a processor for providing a signal to drive the display by receiving a three-or-more color input image signal, which specifies three-or-more color image values at each of a two-dimensional number of sampled addressable spatial locations within an image to be displayed; wherein the processor dynamically forms re-sampling functions for image spatial locations derived from the input image signal and corresponding to the spatial location of each luma-chroma sub-group in the display array based on an analysis of the spatial content of the three-or-more color input image signal and the display array repeating pattern, and applying the re-sampling functions to the three-or-more color input image signal to render a signal for driving each light-emitting element within each corresponding luma-chroma sub-group of light-emitting elements.

ADVANTAGES

The advantages of this invention are a color display device with improved apparent resolution with reduced image processing complexity.

DETAILED DESCRIPTION OF THE INVENTION

Figure 4:
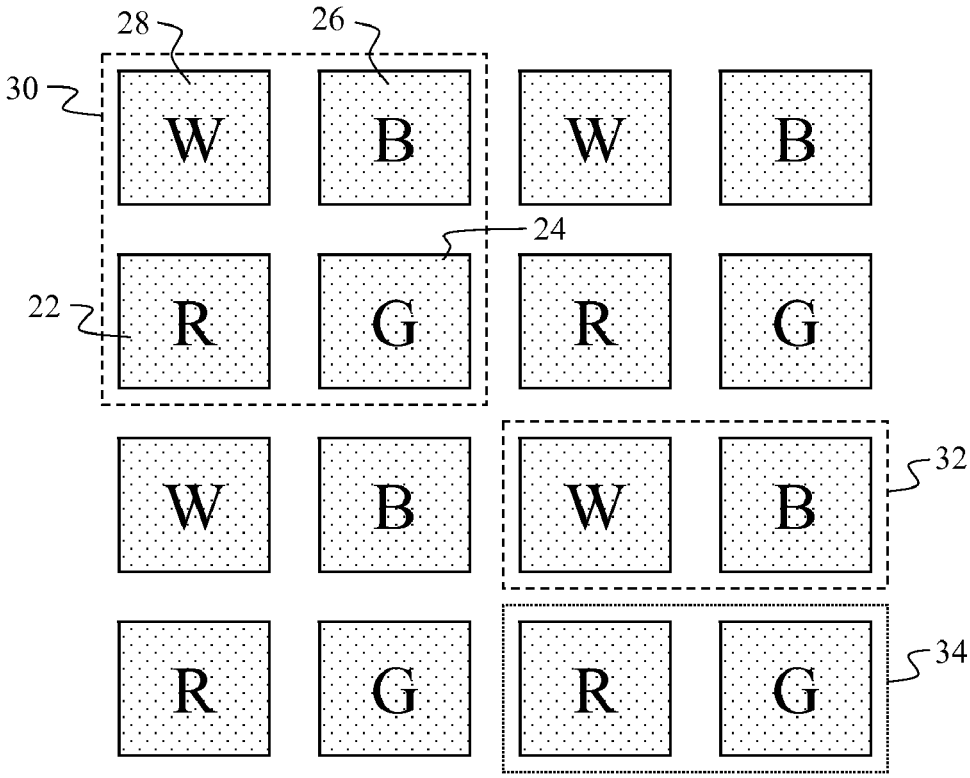
FIG. 4 is a schematic diagram showing the relative sizes and arrangements of light-emitting elements in an array of four pixels and eight luma-chroma sub-groups of light-emitting elements in a display according to one embodiment of the present invention.
Figure 9:
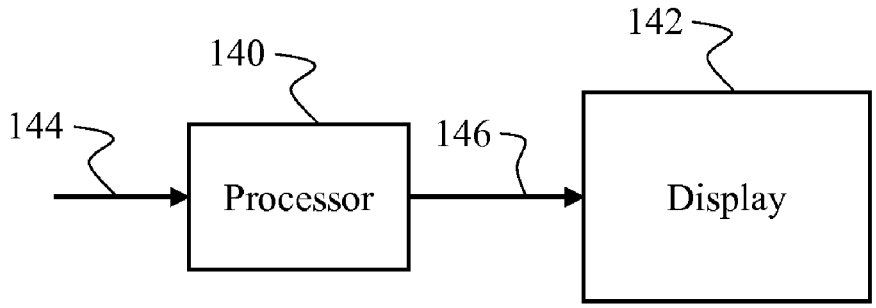
FIG. 9 is a schematic diagram of a system of the present invention.

FIG. 9 illustrates a full-color display system comprised of a display 142 and a processor 140. The display, a portion of which is depicted in FIG. 4 in accordance with one embodiment, is formed from a two-dimensional array of three or more differently colored light-emitting elements 22, 24, 26, 28 arranged in a repeating pattern. The light-emitting elements form a first number of full-color two-dimensional groups 30 of light-emitting elements, each full-color group of light-emitting elements being formed by more than one luma-chroma sub-group 32, 34 of light-emitting elements, wherein the display has a peak white luminance and each luma-chroma sub-group comprises at least one high-luminance light-emitting element having a peak output luminance value that is 40 percent or greater of the peak white luminance of the display device.

The processor provides a signal 146 to drive the display by receiving a three-or-more color input image signal 144, which specifies three-or-more color image values at each of a two-dimensional number of sampled addressable spatial locations within an image to be displayed. Preferably, the addressability of the input image signal in each of the two dimensions approximately matches the number of luma-chroma sub-groups of light-emitting elements along each of the two display dimensions. If this is not the case, then the input image signal in each of the two dimensions may be initially re-sampled to approximately match the number of luma-chroma sub-groups of light-emitting elements along each of the two display dimensions. In accordance with the invention, the processor dynamically forms re-sampling functions for image spatial locations which are derived from the input image signal and correspond to the spatial location of each luma-chroma sub-group in the display array based on an analysis of the spatial content of the three-or-more color input image signal and the display array repeating pattern, and applies the re-sampling functions to the three-or-more color input image signal to render a signal for driving each light-emitting element within each corresponding luma-chroma sub-group of light-emitting elements. By performing an image spatial content dependant re-sampling, color artifacts can be avoided while maintaining high apparent resolution, as more fully described below.

Figure 1:
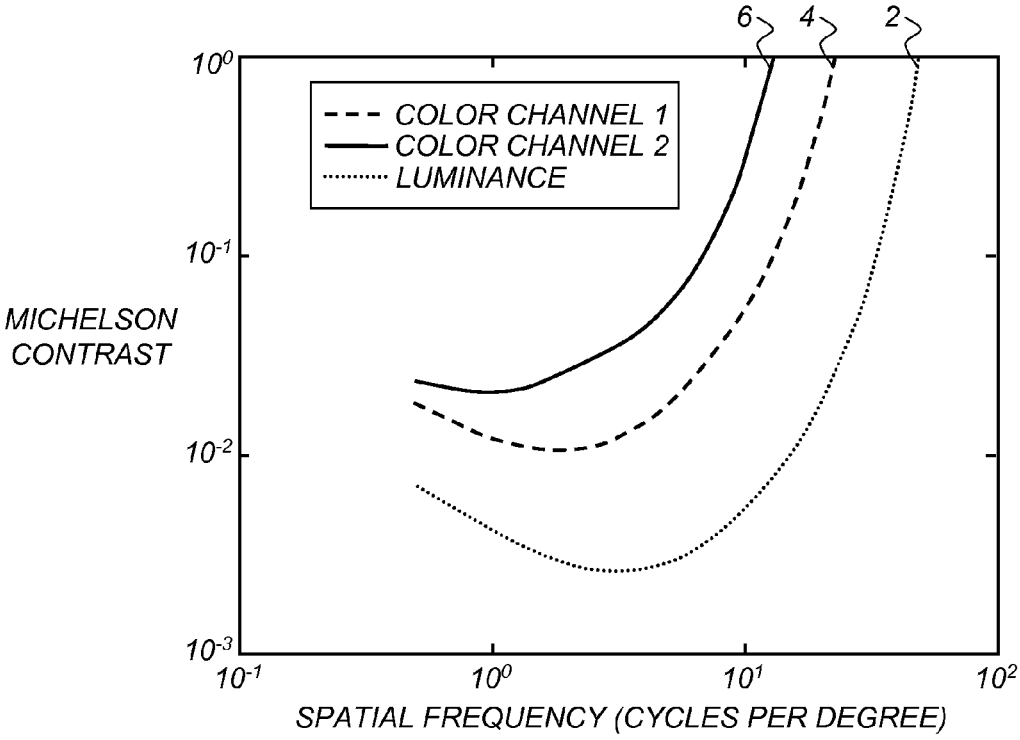
FIG. 1 (PRIOR ART)
FIG. 1 is a graph depicting the human contrast threshold for luminance and chrominance information (prior art)
Figure 2:
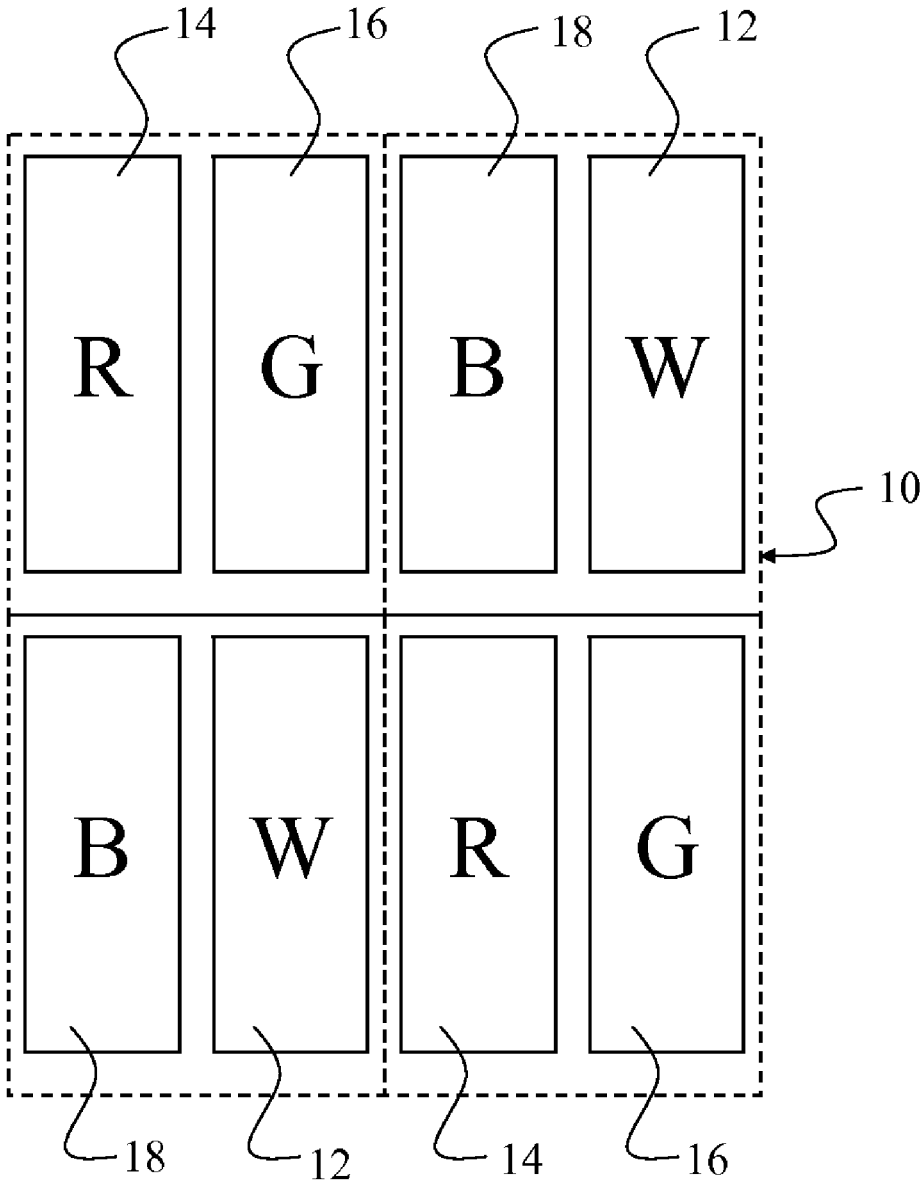
FIG. 2 (PRIOR ART)
FIG. 2 is a schematic diagram showing the relative arrangement of subpixels within a prior art liquid crystal display disclosure.
Figure 3:
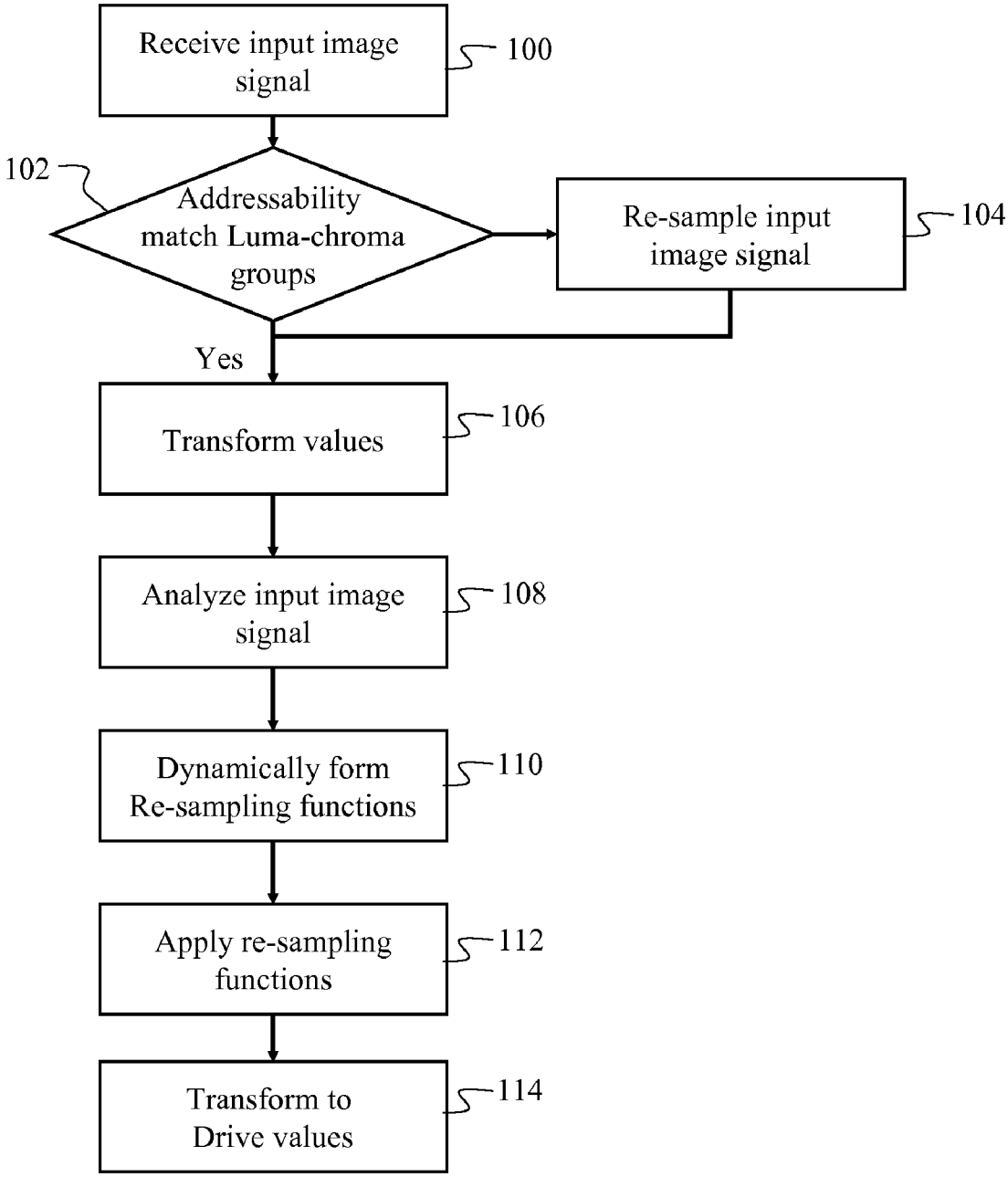
FIG. 3 is a flow diagram depicting the steps that may be performed to enable the present invention.

A method, as shown in FIG. 3, may be employed to enable the current invention when rendering input image information to improve the apparent resolution of a display comprised of a two-dimensional array of three or more differently colored light-emitting elements arranged in a repeating pattern forming a first number of full-color two-dimensional groups of light-emitting elements, each full-color group of light-emitting elements being formed by more than one luma-chroma sub-group of light-emitting elements, wherein the display has a peak white luminance and each luma-chroma sub-group comprises at least one high-luminance light-emitting element having a peak output luminance value that is 40 percent or greater of the peak white luminance of the display device. As shown, this method receives 100 a three-or-more color input image signal, the three-or-more color image signal specifying three-or-more color image values at each of a two-dimensional number of sampled addressable spatial locations within an image to be displayed; optionally resamples 104 the three-or-more color input image signal in each of the two dimensions such that the three-or-more color input image signal has an addressability that is approximately equal to number of luma-chroma sub-groups of light-emitting elements along each of the two display dimensions; optionally transforms 106 the three-or-more color input image signal to an alternate color space; analyzes 108 the spatial content of the three-or-more color input image signal and the display array repeating pattern to determine the spatial content of the three-or-more color input image signal to the three-or-more color input image signal at neighboring spatial locations; dynamically forms 110 re-sampling functions for image spatial locations derived from the input image signal and corresponding to the spatial location of each luma-chroma sub-group in the display array based on the analysis of the spatial content of the three-or-more color input image signal; applies 112 the re-sampling functions to the three-or-more color input image signal to render a signal for driving each light-emitting element within each corresponding luma-chroma sub-group of light-emitting elements; and optionally transforms 114 the re-sampled color image signal values to drive values. By employing such a method that is dependent upon the spatial content of the three-or-more color input image signal and the display array repeating pattern, the fidelity of edge information, apparent resolution and edge sharpness may be improved.

Within this invention, it is important to clearly define and differentiate the terms "pixel", "logical pixel" and "luma-chroma sub-group". Within this invention, a "pixel" refers to the smallest repeating group of light-emitting elements capable of providing the full range of colors the display is capable of producing. That is, each full-color repeating pattern of light-emitting elements form a "pixel" within the display. The term "pixel" will, therefore be used synonymously with the phrase "full-color two-dimensional groups of light-emitting elements". The term "luma-chroma sub-group" refers to a sub-group of light-emitting elements within a pixel that is comprised of one or more light-emitting elements, including at least one distinct (i.e., not shared with another luma-chroma sub-group) high luminance light-emitting element. The "luma-chroma sub-group" may, and typically will, be additionally comprised of one or more additional lower luminance light-emitting elements. Within this definition, a high luminance light-emitting element is a light-emitting element that has a peak output luminance value that is 40 percent or greater of the peak white luminance of the display device while a low luminance light-emitting element is a light-emitting element with a peak output luminance value that less than 40 percent of the peak white luminance of the display device. Within a display comprised of at least red, green, and blue light-emitting elements, the red and blue light-emitting elements will typically be low luminance light-emitting elements while the green light-emitting element will be a high luminance light-emitting element. In displays further comprised of broadband or multi-band light-emitting elements, such as white, yellow, or cyan these broadband or multi-band light-emitting elements will typically be classified as high luminance light-emitting elements. The term "logical pixel" refers to a representation of a spatial location represented within the input image signal. In a typical three-color input image signal, a logical pixel will comprise a red, green, and blue value for each logical location within the image that is represented by the color input image signal. Therefore, the three-or-more color input image signal will have as many logical pixels as addressable spatial locations.

Although the number of luma-chroma sub-groups of light-emitting elements in the display may be the same or different than the addressability (i.e., logical pixels) of the input image signal, the method of the present invention will be particularly advantaged when the number of luma-chroma sub-groups is equal to or smaller than the number of logical pixels. In such a display, the luminance signal present within the three-or-more color input image signal may be rendered such that it is represented primarily by the luma-chroma sub-groups rather than full-color two-dimensional groups of light-emitting elements, thereby improving the perceived resolution of the display device. As such, the display has a higher apparent resolution while employing a smaller number of light-emitting elements.

Figure 5:
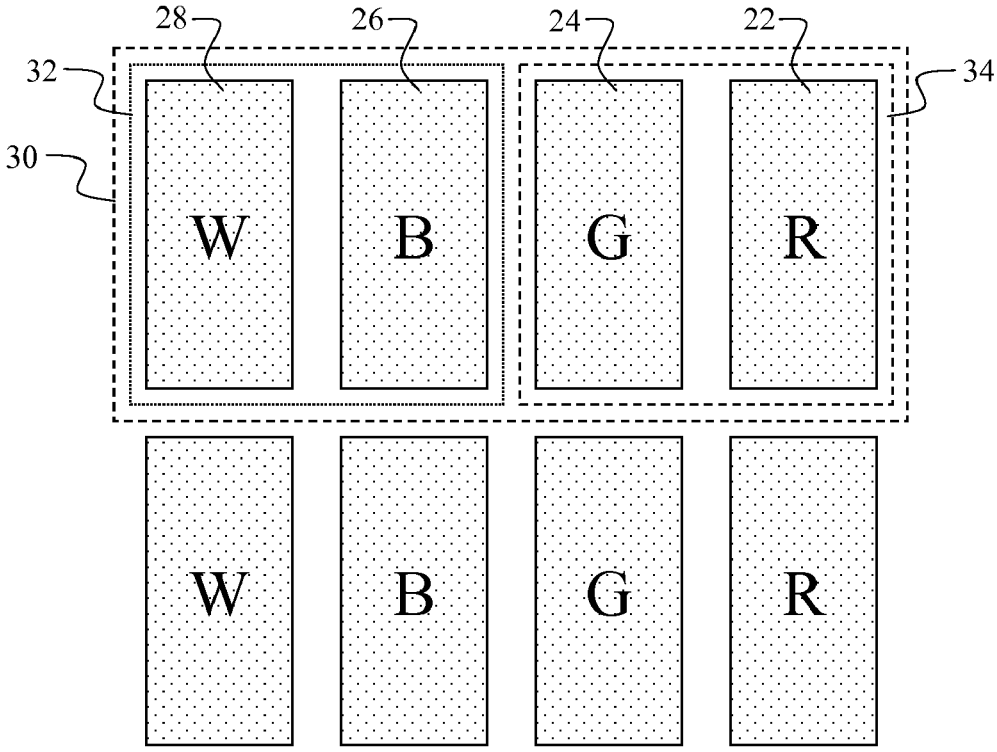
FIG. 5 is a schematic diagram showing the relative sizes and arrangements of light-emitting elements in an array of two pixels and four luma-chroma sub-groups of light-emitting elements in a display according to one embodiment of the present invention.

In one embodiment of a display of the present invention as illustrated in FIG. 4, equal numbers of red 22, green 24, blue 26, and white 28 (RGBW) light-emitting elements are arranged in a two-by-two array having high luminance white 28 and green 24 light-emitting elements positioned in diagonally opposing corners of the array. As shown, these four differently-colored light-emitting elements repeat in the same pattern across the display and thus full-color two-dimensional groups 30 of light-emitting elements (i.e., pixels) are formed from the combination of these four light-emitting elements. Each pixel 30 is comprised of more than one luma-chroma sub-group (32 and 34) of two light-emitting elements each. Within this arrangement, each luma-chroma sub-group (32 or 34) is comprised of at least one high luminance light-emitting element (i.e., green 24 or white 28) and one low luminance light-emitting element (i.e., red 22 or blue 26). In a display having white and green light-emitting elements, these colors of light-emitting elements will typically be included in separate luma-chroma sub-groups and may be diagonally opposed because they both have a large luminance component, thereby increasing the luminance resolution of the image displayed in both the horizontal and vertical dimensions of the display. The luma-chroma sub-groups may be organized in either horizontal or vertical directions or both. For example, in one dimension, a luma-chroma sub-group may comprise white/red and green/blue light-emitting elements, while in another dimension a luma-chroma sub-group may comprise white/blue and green/red light-emitting elements. In an alternative embodiment of RGBW displays, the light-emitting elements may be organized in stripes of green 24 and white 28 light-emitting elements separated by stripes of red 22 and blue 26 light-emitting elements as shown in FIG. 5. Within this arrangement, the white 28 and blue 26 light-emitting elements form a first luma-chroma sub-group 32, the red 22 and green 24 light-emitting elements form a second luma-chroma sub-group 34 and each pair of luma-chroma sub-groups form a pixel 30.

Figure 6:
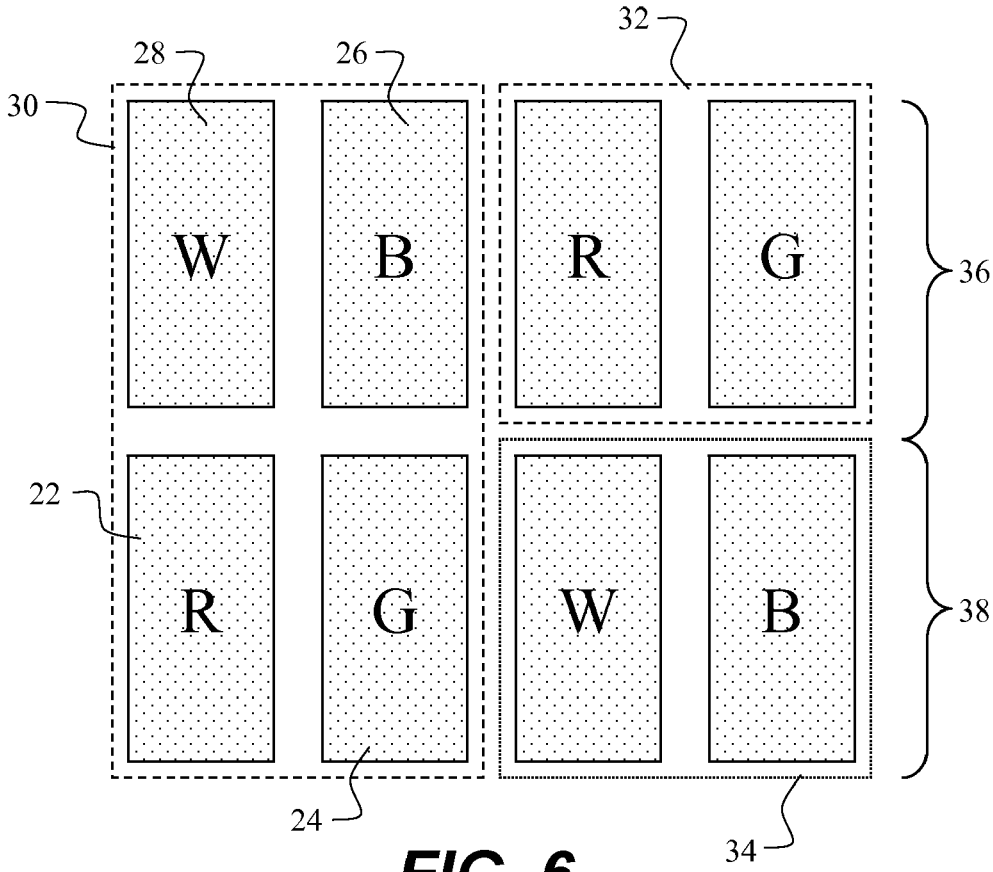
FIG. 6 is a schematic diagram showing the relative sizes and arrangements of light-emitting elements in an array of two pixels and four luma-chroma sub-groups of light-emitting elements in a display according to one embodiment of the present invention wherein each pair of columns of light-emitting elements contain all colors of light-emitting elements.

FIG. 6 shows another arrangement of light-emitting elements for high-resolution displays in which each luma-chroma sub-group 32 and 34 form a square while each pixel 30 is rectangular. Note also that, neighboring pixels may be rotations, mirror images, or reflections of each other. Alternately, the relative positions of the luma-chroma sub-groups may switched in neighboring full-color groups in one dimension as is shown in FIG. 6. The arrangement shown in FIG. 6 is further advantaged over the one shown in FIG. 5 by the fact that each row 36 and 38 and any pair of columns contains all colors of light-emitting elements. As each pair of columns forms a vertical slice of the display equal in width to the height of a row, such arrangement allows any color of line to be formed in the vertical or horizontal direction that is equal in resolution to the height of a luma-chroma sub-group 32 or 34. In an alternative embodiment of the present invention, the white light-emitting elements shown in FIG. 4, 5, or 6 may be replaced by another high luminance light-emitting element. Such alternative high-luminance element may typically include one of cyan, yellow, or additional green light-emitting elements.

Figure 7:
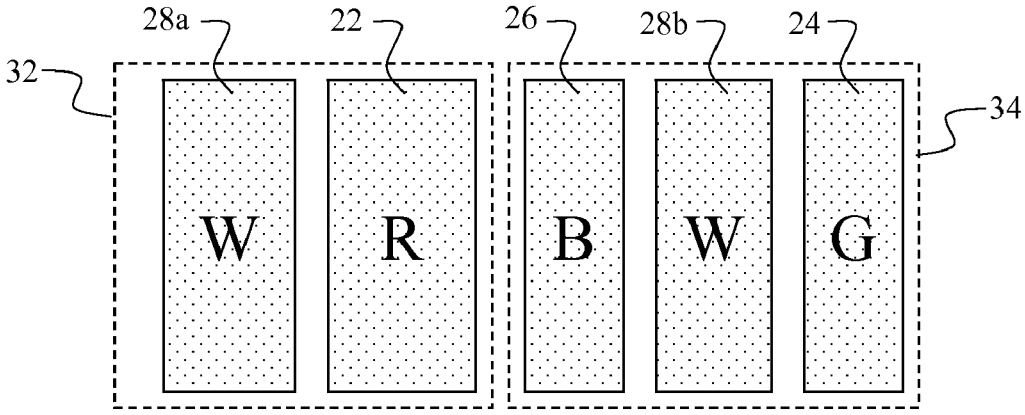
FIG. 7 is a schematic diagram showing the relative sizes and arrangements of light-emitting elements in an array of one pixel and two luma-chroma sub-groups of light-emitting elements in a display according to one embodiment of the present invention wherein at least one of the luma-chroma sub-groups contain more than one high luminance light-emitting element.

An important attribute of the pixel arrangements in a display of the present invention is the presence of a larger number of luma-chroma sub-groups of light-emitting elements than the number of full-color two-dimensional groups of light-emitting elements. As such, it is allowable that multiple high luminance light-emitting elements may further be employed within any luma-chroma sub-group of light-emitting elements or that additional luma-chroma sub-groups be formed from only a single high luminance light-emitting element. FIG. 7 depicts a pixel containing low luminance red 22 and blue 26 light-emitting elements as well as high-luminance green 24 and two white 28*a* and 28*b* light-emitting elements. This pixel is comprised of two luma-chroma sub-groups 32 and 34. A first luma-chroma sub-group 32 is comprised of a high-luminance white light-emitting element 28*a* and a low-luminance red light-emitting element 22. A second luma-chroma sub-group 34 is comprised of two high luminance light-emitting elements (white 28*b* and green 24) as well as a low luminance blue light-emitting element 26. Similar pixel patterns may be formed using two colors of light-emitting elements in place of the two white light-emitting elements 28*a* and 28*b*. Particularly interesting combinations for these two colors of light-emitting elements include white and cyan, white and yellow and yellow and cyan. Demonstrated by this embodiment, the light-emitting elements may have different sizes and the area of each color of light-emitting element may vary. As is well known, in some emissive displays, such as OLEDs, the emissive materials may age over time, and emissive materials emitting different colors of light may age at different rates. This differential color aging may be mitigated by employing differently sized light-emitting elements corresponding to the relative aging rates. The light-emitting elements may further be different in size to facilitate accurate color balance at the same drive level.

To practice a display system of the present invention, a processor will be provided. This processor will be configured to employ a method, similar to the one shown in FIG. 3, to render the information to a display of the present invention. Such a method will begin with the process of receiving 100 a three-or-more color input image signal, which specifies the three-or-more color image signal at each of a two-dimensional number of addressable spatial locations, the number of addressable spatial locations in each dimension specifying the addressability of the image signal along each dimension. This three-or-more color image signal may be represented in a number of viable formats and may represent the relative luminance output of the display in any of a number of viable color spaces, including sRGB, YCC, and display image intensity values. The three-or-more color input image signal may, if necessary, be analyzed to determine 102 if the addressability of the three-or-more color input image signal matches the number of luma-chroma sub-groups of light-emitting elements along each of the two display dimensions. If the addressability of the three-or-more color input image signal does not approximately equal the number of luma-chroma subgroups of light-emitting elements along each of the two display dimensions, the three-or-more color input image signal may be initially re-sampled 104 to have the same addressability as the three-or-more color input image signal. This process of re-sampling may employ any re-sampling process as known in the prior art, including spatial interpolation of each of the three-or-more color input image signals using linear, bi-linear, bi-cubic or other prior art techniques. It should be noted that steps 102 and 104 are optional and may, in fact be combined with steps 108 and 110 as will be described later.

The three-or-more color input image signal values for the selected spatial locations may then be transformed 106 into linear intensity values suitable for driving the differently colored light-emitting elements of the display if they are not already encoded in this metric. This transformation, if required, may include a table look-up for each color channel and a color matrix and may include additional steps, such as color conversion. In one example, when the colors of light-emitting elements include only red, green, and blue light-emitting elements and the three-or-more color input image signal is comprised of a standard sRGB image file, the transformation may include one or more look up tables to convert the non-linearly encoded sRGB values to linear intensity and a 3×3 matrix to rotate the colors of the sRGB image file from colors that are intended to be displayed on a display having sRGB primaries to primary colors of the display device. For the same input image file, if the display is comprised of a four or more colors of light-emitting elements, additional conversion steps may be necessary to convert from a three color image to a four-or-more color image. Several methods for this conversion are known in the art. One such method is provided in U.S. Pat. No. 6,885,380, entitled "Method for transforming three colors input signals to four or more output signals for a color display" which is hereby included by reference. Another such method is described in U.S. application Ser. No. 11/429,839, the disclosure of which is incorporated by reference herein. Such methods for RGBW displays often involve determining the neutral luminance at each spatial location represented in the three-or-more color input image signal and adding at least a portion of this luminance to the white channel, while possibly subtracting a portion of this luminance from the red, green, and blue channels. Conversion algorithms for displays having additional high luminance light emitting elements that are not white in color, often employ methods where the amount of luminance that may be produced by the additionally colored light emitting element to form the color represented by the three-or-more color input image signal is determined and a portion of this luminance is subtracted from the RGB signal and added to the signal for the additional light-emitting element.

Once this transformation is complete, relative luminance values are available for each color of light-emitting element at each spatial location in the three-or-more color input image signal. However, it should be noted that at each corresponding spatial location on the display device, only a luma-chroma sub-group of light-emitting elements are present, instead of a full-color grouping of light-emitting elements, which would be capable of displaying each of the color values in the transformed image signal. Therefore, it is necessary to re-sample the transformed image signal to a spatial representation that is consistent with the arrangement of luma-chroma sub-groups of light-emitting elements. As noted earlier, prior art implementations of this re-sampling process employ subpixel interpolation methods using even functions that are typically implemented through the convolution of the input image signal with symmetric kernels, wherein these symmetric kernels typically blur edge information when they are applied. To accomplish this re-sampling in a way that maintains the structural integrity of the spatial information in the three-or-more color input image signal, the values for rendering information to each luma-chroma sub-group of light-emitting elements must be derived from neighboring values, often using uneven functions, which may, for example, be implemented by convolving highly non-symmetric kernels with the input image signal. However, to form the weightings of such non-symmetric kernels, it is necessary to understand and react to the local image content that is to be displayed.

Figure 8:
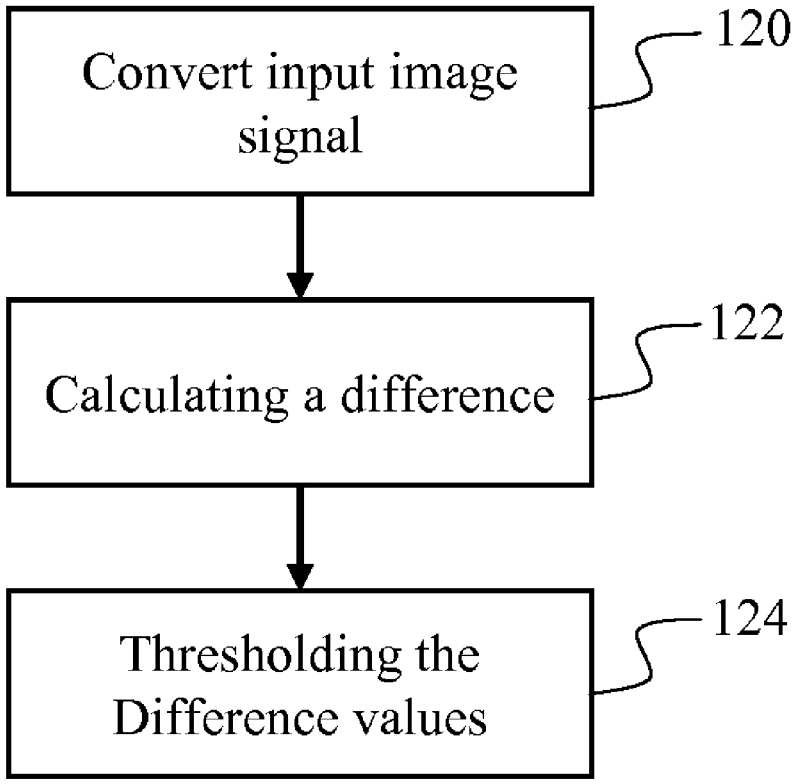
FIG. 8 is a flow diagram depicting the steps that may be performed during the analysis step of the present invention.

To accomplish this, the three-or-more color input image signal (directly or indirectly via a derivative thereof) is then analyzed 108 at each spatial location to determine the neighboring spatial locations within the three-or-more color input image signal which have similar luminance and/or chrominance values to the luminance and/or chrominance value of the three-or-more color input image signal value at the spatial location to be rendered to a corresponding luma-chroma sub-group of light-emitting elements. This analysis may take many forms. However, one method that may be usefully employed is depicted in FIG. 8 and includes converting 120 the three-or-more color input image signal value or a derivative of this signal to a value correlated to a metric that may be analyzed to predict human sensitivity to edge information. For instance, the signal may be used to compute relative luminance by computing a weighted average of the three-or-more color input image signal values at each spatial location. Similarly chrominance values may further be calculated as is known in the art and then used to calculate a combined luminance/chrominance metric such as CIELab values. The resulting values are then used to calculate 122 a value that is directly indicative of the perceived strength of an edge when the image is displayed. One such metric may be obtained by calculating the absolute difference between the resulting luminance value for the spatial location to be rendered to a corresponding luma-chroma sub-group of light-emitting elements and the luminance values for neighboring spatial locations. Although, these differences may be computed independently, they may also be computed during the process of applying a sharpening kernel to the image, wherein the sharpening kernel determines difference values. The resulting values may then be thresholded 124 to eliminate or reduce any random variability. While this method employs only the luminance signal, one or more chrominance signals may be computed in addition to or in place of the luminance signal and a similar analysis may be employed. Further, while all of the three-or-more color input image signal values may be analyzed in this way for all of the immediate neighboring spatial locations, it may further be analyzed for larger groups of neighboring spatial locations, including the immediate neighbors of the neighboring spatial locations. Further, it is not necessary that all neighbors be included, instead sub-groups, such as the neighboring spatial locations which correspond only to luma-chroma sub-groups that contain differently colored light-emitting elements than the luma-chroma sub-group corresponding to the spatial location for which the three-or-more color input image signal value is being analyzed. Note that this analysis step and all subsequent steps are necessary to form the signal that will drive each light-emitting element within each luma-chroma sub-group and as such, at any spatial location, this and subsequent calculations only need to be done for the color channels of the input image signal that will be used to drive the light-emitting elements within the luma-chroma sub-group that corresponds to the spatial location within the three-or-more color input image signal. For example, when rendering information to luma-chroma sub-group 32 of FIG. 6 which contains white 28 and blue 26 light-emitting elements this step and all subsequent steps need only be performed for the white and blue channels within the transformed three-or-more color input image signal. Likewise when rendering information to luma-chroma sub-group 34 of FIG. 6, which contains green 24 and red 22 light-emitting elements, this step and all subsequent steps need only be performed for the green and red channels within the transformed three-or-more color input image signal. For this reason, the analysis 108 and dynamically forming 110 steps must consider the pattern of light-emitting elements in addition to the spatial content of the input image signal.

Once the spatial content of the three-or-more color input image signal has been analyzed 102 at a spatial location, a re-sampling function is dynamically formed 104. This re-sampling function may be obtained either by dynamically re-weighting a single function and/or by dynamically re-selecting functions from an existing group of functions. In one embodiment, a 3×3 kernel may be dynamically formed based on the spatial content of the input image by assigning a first weighting value to the center element of the 3×3 kernel, assigning a second value to the remaining elements of the kernel for which the corresponding three-or-more color input image signal was similar to the three-or-more color image signal corresponding to the center element of the 3×3 kernel (i.e. the values that were thresholded to zero in step 108) and assigning a third value to the remaining elements of the kernel (i.e. the values corresponding to the neighboring spatial locations that were thresholded to a larger value in step 108), wherein the second kernel value is substantially larger than the third kernel value. The kernel values may then be summed and this sum may be used to normalize the kernel such that all values within the kernel sum to 1. In an alternative embodiment, calculated values, such as the difference values obtained in step 122 may be used directly to dynamically form the function. That is, the difference values calculated during the analyze image step 108, may be transformed, for example by multiplying their inverse by a constant, to obtain kernel values. Note that the step of computing the inverse provides a larger weighting for neighboring spatial locations with similar luminance and/chrominance values and a significantly smaller weighting for neighboring spatial locations with dissimilar luminance and/or chrominance values. These values may be summed, and normalized to a value less than 1 and the difference between this normalized value and 1 may be assigned as the value for the center element of the kernel. This process effectively forms a function for each luma-chroma sub-group that when applied to the input image signal values forces the luminance and chrominance error that is present when rendering the image information to a luma-chroma sub-group to be represented primarily by neighboring luma-chroma sub-groups of light-emitting elements having similar luminance and/or chrominance values and prevents this information from being represented by neighboring luma-chroma sub-groups of light-emitting elements that are significantly different in luminance. As such, this re-sampling process maintains perceived sharpness of the image.

Notice that in the example that was just provided, the three-or-more color input image signal, which specifies three-or-more color image values at each of a two-dimensional number of sampled addressable spatial locations within an image to be displayed had sampled addressable spatial locations that corresponded exactly to the location of each luma-chroma sub-group. While this condition simplifies the dynamic formation of the re-sampling functions, it is not necessary. In fact, it may be common for image spatial locations derived from the input image signal which correspond to the spatial location of each luma-chroma sub-group in the display array to be located between image spatial locations. This condition may be handled using various approaches as known in the art in combination with the dynamic re-sampling function of the present invention. For example, the present invention may be employed in combination with application of an odd function to weigh neighboring spatial locations within the input image signal as a function of their distance from the derived spatial locations and these weighting functions may be convolved with the dynamically formed re-sampling function to form the final function.

The re-sampling functions are then applied 112 to the transformed three-or-more color input image signal that was obtained in step 106 to re-sample the values to the luma-chroma sub-groups thereby rendering the three-or-more color input signal to the arrangement of light-emitting elements of the display with reduced blurring. It should be noted in the prior art such as discussed in US Patent Application 2005/0225563, re-sampling is achieved by applying at least one low-pass function instituted through a relatively large kernel which provides subpixel interpolation. This symmetric, non-adaptive, low-pass function effectively blurs the edge information. Therefore, as this disclosure discusses, subsequent sharpening operations are then required to regain some of the low frequency contrast that was lost during subpixel interpolation, and finally an additional filter is applied to re-center the image signal to the correct light-emitting element. While the later two functions may also be applied in conjunction with the dynamic re-mapping function discussed herein, the fact that the current method does not introduce significant edge blurring during subpixel interpolation significantly reduces the need for these functions, and accordingly may overall reduce the complexity of the image processing path. The resulting values are then transformed 114 to a drive values for the light-emitting elements (typically, e.g., employing a non-linear look-up table to compensate for the relationship between drive voltage and output luminance).

It should be noted that it may be advantageous to transform the three-or-more color input image signal into a luminance or a luminance and chrominance representation to facilitate the image analysis step 108. However, once in a luminance/chrominance representation, other image manipulations may be performed. For instance, the luminance channel may undergo sharpening. Sharpening using a single convolution to sharpen this one channel results in an image that when transformed to a three-or-more color space for rendering contains three-or-more channels that all have apparently higher sharpness. By performing this manipulation, processing power required to implement the image processing steps may be significantly reduced. Also while in a luminance/chrominance color space, other image processing may be more readily performed such as blurring the chrominance channels of the image. Such an operation will introduce little, if any, apparent blur in the image. However, this manipulation will allow the display to use all colors of light-emitting elements to render neutral edge information since such an operation will reduce the saturation of the image signal at color edges. The fact that all of the light-emitting elements may then be used to render color edges, improves edge fidelity, once again, improving the apparent resolution of the display device.

Having disclosed the basic concept of this invention, it is instructive to provide an example of such an image processing method. To accomplish this, a comparative example will be provided. To facilitate this example, a three color input image signal is provided for a four by four array of logical pixels as shown in Table 1. Note that the rows and columns of Table 1 are numbered such that each spatial location can be noted by the convention row, column such that the spatial location 2,3 represents the spatial location at row 2, column 3. Notice also that each logical pixel of the matrix contains three values. In this example, these numbers represent the 8-bit code values for the red, green, and blue color input image signals, respectively, for an image with a dark square surrounded by a gray background. The dark square is represented in the intersections of the second and third rows and columns of the matrix and has an instantaneous boundary, which is desirable to maintain the perceived sharpness of the image. Also, to provide greater context for this example, we will assume that this represents a small distinct image within a surrounding flat field. That, is there are additional spatial values represented beyond this matrix and we will assume that the code values for all surrounding logical pixels are equal to those shown in the perimeter of this region (i.e., they are 128, 128, 128).

TABLE 1

| | Column 1 | Column 2 | Column 3 | Column 4 |
|---|---|---|---|---|
| Row 1 | 128, 128, 128 | 128, 128, 128 | 128, 128, 128 | 128, 128, 128 |
| Row 2 | 128, 128, 128 | 64, 64, 64 | 64, 64, 64 | 128, 128, 128 |
| Row 3 | 128, 128, 128 | 64, 64, 64 | 64, 64, 64 | 128, 128, 128 |
| Row 4 | 128, 128, 128 | 128, 128, 128 | 128, 128, 128 | 128, 128, 128 |

To further facilitate this example, Table 2 depicts the array of corresponding luma-chroma sub-groups of light-emitting elements that form the corresponding spatial locations in the display device (e.g., for a display with a light-emitting element layout similar to that of FIG. 6). Within this table, the letters represent the colors of light-emitting elements that form each luma-chroma sub-group corresponding to each three color input image signal shown in Table 1. Note that within Table 2, W, B, R, G represent the presence of white, blue, red and green light-emitting elements, respectively. Also note that in this example, columns refer to columns of luma-chroma sub-groups, rather than to columns of individual light-emitting elements, and the number of logical pixels in the image signal is equal to the number of luma-chroma sub-groups.

TABLE 2

| | Column 1 | Column 2 | Column 3 | Column 4 |
|---|---|---|---|---|
| Row 1 | W, B | R, G | W, B | R, G |
| Row 2 | R, G | W, B | R, G | W, B |
| Row 3 | W, B | R, G | W, B | R, G |
| Row 4 | R, G | W, B | R, G | W, B |

Throughout each of the examples, it will be assumed that the display is comprised of red, green, blue and white light-emitting elements where the chromaticity coordinates of the white light-emitting elements are equal to the chromaticity coordinates of the display white point. It will also be assumed that the addressability of the three channel input image signal is equal to the number of luma-chroma sub-groups. It will further be assumed that the input image signal values shown in Table 1 are represented in a linear luminance metric and that half of the neutral luminance will be converted from the RGB channels to the white channel in the image. Making these assumptions, our example will begin with transformation of the RGB code values into RGB intensity values by normalizing the values in Table 1 by their maximum value, e.g., dividing by 255. The normalized RGB intensity values are then transformed to RGBW relative intensity values by subtracting half the minimum of the RGB values for each logical pixel from the normalized RGB intensity values, and assigning the remaining half-minimum values to the W channel. These transformed 106 values are shown in Table 3 where the values are represented as red, green, blue, white relative intensity.

TABLE 3

| | Column 1 | Column 2 | Column 3 | Column 4 |
|---|---|---|---|---|
| Row 1 | 0.25, 0.25, 0.25, 0.25 | 0.25, 0.25, 0.25, 0.25 | 0.25, 0.25, 0.25, 0.25 | 0.25, 0.25, 0.25, 0.25 |
| Row 2 | 02.5, 0.25, 0.25, 0.25 | **0.125, 0.125, 0.125, 0.125** | **0.125, 0.125, 0.125, 0.125** | 0.25, 0.25, 0.25, 0.25 |
| Row 3 | 0.25, 0.25, 0.25, 0.25 | **0.125, 0.125, 0.125, 0.125** | **0.125, 0.125, 0.125, 0.125** | 0.25, 0.25, 0.25, 0.25 |
| Row 4 | 0.25, 0.25, 0.25, 0.25 | 0.25, 0.25, 0.25, 0.25 | 0.25, 0.25, 0.25, 0.25 | 0.25, 0.25, 0.25, 0.25 |

Inventive Example

In the inventive example, re-sampling functions for the logical pixels are formed based on an analysis of the spatial content of the RGB input image signal and the display array repeating pattern. More particularly, in this example, the analysis of the spatial content according to step 108 begins by computing an average of the values for each logical pixel shown in Table 1, and the absolute differences between the value for each logical pixel and its neighbors. The result is the matrix shown in Table 4. According to one embodiment, these values may be thresholded. In this example, these values may be thresholded such that all numbers less than 32 are set to 1. These spatial locations are indicated through the use of bold numerals.

TABLE 4

| | Column 1 | | | Column 2 | | | Column 3 | | | Column 4 | | |
|---|---|---|---|---|---|---|---|---|---|---|---|---|
| Row 1 | **0** | **0** | **0** | **0** | **0** | **0** | **0** | **0** | **0** | **0** | **0** | **0** |
| | **0** | **0** | **0** | **0** | **0** | **0** | **0** | **0** | **0** | **0** | **0** | **0** |
| | **0** | **0** | 64 | **0** | 64 | 64 | 64 | 64 | **0** | 64 | **0** | **0** |
| Row 2 | **0** | **0** | **0** | 64 | 64 | 64 | 64 | 64 | 64 | **0** | **0** | **0** |
| | **0** | **0** | 64 | 64 | **0** | **0** | **0** | **0** | 64 | 64 | **0** | **0** |
| | **0** | **0** | 64 | 64 | **0** | **0** | **0** | **0** | 64 | 64 | **0** | **0** |
| Row 3 | **0** | **0** | 64 | 64 | **0** | **0** | **0** | **0** | 64 | 64 | **0** | **0** |
| | **0** | **0** | 64 | 64 | **0** | **0** | **0** | **0** | 64 | 64 | **0** | **0** |
| | **0** | **0** | **0** | 64 | 64 | 64 | 64 | 64 | 64 | **0** | **0** | **0** |
| Row 4 | **0** | **0** | 64 | **0** | 64 | 64 | 64 | 64 | **0** | 64 | **0** | **0** |
| | **0** | **0** | **0** | **0** | **0** | **0** | **0** | **0** | **0** | **0** | **0** | **0** |
| | **0** | **0** | **0** | **0** | **0** | **0** | **0** | **0** | **0** | **0** | **0** | **0** |

Once the analysis step 108 is complete, the re-sampling function may be dynamically formed 110 based upon this analysis step. In the case of this example we will form the re-sampling function in the form of a convolution kernel where all values less than 32 in the 3×3 matrices shown above are set to one and all values greater than or equal to 32 are set to 0.5. Further, the values within the kernels that are either directly or horizontally displaced from the center of the kernel will be multiplied by 2. Finally, the center value of each 3×3 matrix is then set to a value of 4. Note that by applying these values, the un-normalized weights of the kernel in a flat field would be as shown in Table 5. However, when near an edge, the magnitude of the off-center elements is reduced to half the value shown. The full convolution kernel for each spatial location may then be normalized by dividing this 3×3 matrix by the sum of the matrix.

TABLE 5

| | | |
|---|---|---|
| 1 | 2 | 1 |
| 2 | 4 | 2 |
| 1 | 2 | 1 |

Finally, the input image signal may be re-sampled by applying 112 the re-sampling function. This process is completed in this example by convolving each of these 3×3 kernels with the color channels for which there are corresponding light-emitting elements in the corresponding luma-chroma subgroups of the display and these values may be used to drive the display. Note that it is not necessary to perform a convolution with the color channels at each spatial location where there are no corresponding light-emitting elements and these values can simply be set to zero. When this is complete, an R,G,B,W four-color image signal is formed at each spatial location as shown in Table 6.

TABLE 6

| | Column 1 | Column 2 | Column 3 | Column 4 |
|---|---|---|---|---|
| Row 1 | 0, 0, 0.25, 0.25 | 0.24, 0.24, 0, 0 | 0, 0, 0.24, 0.24 | 0.25, 0.25, 0, 0 |
| Row 2 | 0.24, 0.24, 0, 0 | **0, 0, 0.16, 0.16** | **0.16, 0.16, 0, 0** | 0, 0, 0.24, 0.24 |
| Row 3 | 0, 0, 0.24, 0.24 | **0.16, 0.16, 0, 0** | **0, 0, 0.16, 0.16** | 0.24, 0.24, 0, 0 |
| Row 4 | 0.25, 0.25, 0, 0 | 0, 0, 0.24, 0.24 | 0.24, 0.24, 0, 0 | 0, 0, 0.24, 0.25 |

Notice that in this example, sharpness is degraded somewhat as the values corresponding to the gray background are sometimes less than 0.25 and the values corresponding to the gray square are greater than 0.125. However, depending upon the numbers that are assigned to the non-similar input image signals, a smaller or larger portion of this sharpness may be sacrificed to avoid severe aliasing or color errors. Further, by forming the function directly as a function of the analysis image, the degree of loss of sharpness may be tuned as a function of edge contrast, reducing sharpness for low contrast edges, where such changes are less likely to be noticed. It should also be noted that near edges the convolution kernels formed in this example are decidedly non-symmetric and therefore the functions they implement are odd. For instance, the initial kernel, before normalization to a sum of 1, used to interpolate the input image signal at the spatial location corresponding to row 2, column 2 is a 3×3 matrix comprising the elements shown in Table 7. Notice that the spatial locations to the left of the spatial locations being interpolated are zero while the last two columns to the right are ones, making this function an odd function.

TABLE 7

| | | |
|---|---|---|
| 0.5 | 1 | 0.5 |
| 1 | 4 | 2 |
| 0.5 | 2 | 1 |

Comparative Example

The prior art uses a fixed, symmetric kernel as discussed in US Patent Application 2005/0225563. A kernel from this application may be used to provide a comparative example. The un-normalized kernel values from this disclosure are shown in Table 8. It should further be noted, that the values match the kernel values shown in Table 5. That is, this comparative example and the inventive example would employ the same un-normalized kernel when operating on an image with uniform spatial content (e.g., a flat field). However, because the inventive example adjusts its behavior in the presence of edges within the input image signal, it modifies this un-normalized kernel to maintain sharpness.

TABLE 8

| | | |
|---|---|---|
| 1 | 2 | 1 |
| 2 | 4 | 2 |
| 1 | 2 | 1 |

Applying this kernel to the image data results in the values shown in Table 9. Notice the resulting values are blurred since there are no values as high as 0.25 or as small as 0.125 in this example. Comparing the results in Table 9 to the results in Table 7, one can see that the numbers in Table 9 corresponding the background are further from 0.25 than the values corresponding the background shown in Table 7. Further, the values in Table 9 corresponding to the square are further from 0.125 than the values corresponding to the square in Table 7. Therefore, one can conclude that more blur will be introduced by the comparative example than the inventive example.

TABLE 9

| | Column 1 | Column 2 | Column 3 | Column 4 |
|---|---|---|---|---|
| Row 1 | 0.24, 0.24, 0.24, 0.24 | 0.225, 0.225, 0.225, 0.225 | 0.225, 0.225, 0.225, 0.225 | 0.24, 0.24, 0.24, 0.24 |
| Row 2 | 0.225, 0.225, 0.225, 0.225 | **0.18, 0.18, 0.18, 0.18** | **0.18, 0.18, 0.18, 0.18** | 0.225, 0.225, 0.225, 0.225 |
| Row 3 | 0.225, 0.225, 0.225, 0.225 | **0.18, 0.18, 0.18, 0.18** | **0.18, 0.18, 0.18, 0.18** | 0.225, 0.225, 0.225, 0.225 |
| Row 4 | 0.24, 0.24, 0.24, 0.24 | 0.225, 0.225, 0.225, 0.225 | 0.225, 0.225, 0.225, 0.225 | 0.24, 0.24, 0.24, 0.24 |

While the display and method of the present invention might be practically applied with any direct view or projection display technology that employs spatially non-co-incident light-emitting elements, it will have the most benefit in displays having four or more than four colors of light-emitting elements. Such displays have been demonstrated for many technologies but may have the most practical value whenever a white light emission system is used in conjunction with color filters or other color change materials that reduce the efficiency of light emission to produce a full color displays. It is well known and documented in the art that the power efficiency of both liquid crystal and organic light-emitting diode displays, which generate a white light and filter this light with color filters to produce light-emitting elements having red, green, and blue light-emitting elements can be improved significantly through the addition of one or more high-luminance light-emitting elements which employ one or more light-emitting elements with either broader band color filters or do not employ a color filter. Therefore, this invention may be particularly suited to application in these types of displays.

The invention has been described in detail with particular reference to certain preferred embodiments thereof, but it will be understood that variations and modifications can be effected within the spirit and scope of the invention.

PARTS LIST

| | |
|---|---|
| 2 | contrast sensitivity for luminance signal |
| 4 | contrast sensitivity for red/green chrominance |
| 6 | contrast sensitivity for blue/yellow chrominance |
| 10 | display |
| 12 | white subpixel |
| 14 | red subpixel |
| 16 | green subpixel |
| 18 | blue subpixel |
| 22 | red light-emitting element |
| 24 | green light-emitting element |
| 26 | blue light-emitting element |
| 28, 28a, 28b | white light-emitting element |
| 30 | full-color two-dimensional repeating pattern |
| 32 | first luma-chroma sub-group |
| 34 | second luma-chroma sub-group |
| 36 | first row |
| 38 | second row |
| 100 | receiving step |
| 102 | determining step |
| 104 | optional re-sampling step |
| 106 | optional transforming step |
| 108 | analyzing step |
| 110 | forming re-sampling function step |
| 112 | apply re-sampling function step |
| 114 | optional transforming step |
| 120 | converting step |
| 122 | calculate step |
| 124 | thresholding step |
| 140 | processor |

-continued

PARTS LIST

| | |
|---|---|
| 142 | display |
| 144 | input signal |
| 146 | drive signal |

The invention claimed is:

1. A full color display system comprised of:

a) a display which is formed from a two-dimensional array of three or more differently colored light-emitting elements arranged in a repeating pattern forming a first number of full-color two-dimensional groups of light-emitting elements arranged in rows and columns, each full-color group of light-emitting elements being formed by more than one luma-chroma sub-group of light-emitting elements wherein each luma-chroma sub-group in a full-color group comprises a spatial arrangement of at least two light-emitting elements, wherein the display has a peak white luminance and each luma-chroma sub-group comprises at least one distinct high-luminance light-emitting element having a peak output luminance value that is 40 percent or greater of the peak white luminance of the display device and at least one distinct low-luminance light-emitting element having a peak output luminance value that is less than 40 percent of the peak white luminance of the display device; and b) a processor for providing a signal to drive the display by receiving a three-or-more color input image signal that specifies three-or-more color image values at each of a two-dimensional number of sampled addressable spatial locations within an image to be displayed:

wherein the processor dynamically forms re-sampling functions for image spatial locations derived from the input image signal that;

i) correspond to the known spatial location of each luma-chroma sub-group in the display array;

ii) are dependent upon the similarity of the three-or-more color input values at two or more neighboring spatial locations of the image input signal;

iii) are based on an analysis of the spatial content of the three-or-more color input image signal and the display array repeating pattern wherein the analysis comprises a thresholding of a calculation of an absolute difference between a luminance value for a spatial location to be rendered to a corresponding luma-chroma sub-group and the luminance values of the two or more neighboring spatial locations of the image input signal; and iv) are implemented by convolving highly non-symmetrical kernels with the input image signal wherein the kernels are dynamically formed matrices based on the spatial content of the input image signal by assigning a first weighting value to a center element of the kernel, assigning a second value to the remaining elements of the kernel for which the corresponding three-or-more color input image signal has a similarity to the three-or-more color image signal corresponding to the center element of the kernel, and assigning a third value to the remaining elements of the kernel, wherein the second kernel value is substantially larger than the third kernel value;

v) applies the re-sampling functions to the three-or-more color input image signal to render a signal for driving each light-emitting element within each corresponding luma-chroma sub-group of light-emitting elements.

2. The display system of claim 1, wherein each luma-chroma sub-group includes a single high luminance light-emitting element, and a single low luminance light-emitting element having a peak output luminance value that is less than 40 percent of the peak white luminance of the display device.

3. The display system according to claim 1, wherein the light-emitting elements include red, green, and blue light-emitting elements, including twice as many green light-emitting elements as red or blue light-emitting elements, wherein one luma-chroma sub-group of light-emitting elements includes red and green light-emitting elements and a second luma-chroma sub-group of light-emitting elements includes blue and green light-emitting elements.

4. The display system according to claim 1, wherein the light-emitting elements include red, green, blue and at least one additional color light-emitting element, wherein the at least one additional color light-emitting element comprises a white, yellow, or cyan light-emitting element.

5. The display system according to claim 4, wherein the display has exactly one additional color light-emitting element and the one additional color light-emitting element and one of the red or blue light-emitting elements comprise a luma-chroma sub-group and wherein the green and the remaining of the red or blue light-emitting elements comprise another luma-chroma sub-group.

6. The display system according to claim 4, wherein the color of the at least one additional color light-emitting element is white and the display is comprised of more white light-emitting elements than at least one of red, green, or blue light-emitting elements.

7. The display system according to claim 1, wherein the light-emitting elements include equal numbers of white, red, green, and blue light-emitting elements and the light-emitting elements are formed in two-by-two arrays having diagonally opposed green and white light-emitting elements.

8. The display system according to claim 1, wherein each full-color group of light-emitting elements is formed from a pair of luma-chroma subgroups, and wherein the relative positions of the luma-chroma sub-groups are switched in neighboring full-color groups in one dimension.

9. The display system according to claim 1, wherein the light-emitting elements include equal numbers of white, red, green, and blue light-emitting elements and the light-emitting elements are formed in stripes of common colored light-emitting elements, and wherein the stripes of green light-emitting elements are separated from the stripes of white light-emitting elements by stripes of red or blue light-emitting elements.

10. The display system according to claim 1, wherein the horizontal and vertical dimension of each luma-chroma sub-group are substantially equal.

11. The display system according to claim 1, wherein one of the horizontal and vertical dimensions of each luma-chroma sub-group is substantially twice the remaining dimension of each luma-chroma sub-group.

12. The display system according to claim 1, wherein the light-emitting elements have different sizes.

13. A method for rendering input image information to improve the apparent resolution of a display comprised of a two-dimensional array of three or more differently colored light-emitting elements arranged in a repeating pattern forming a first number of full-color two-dimensional groups of light-emitting elements arranged in rows and columns, each full-color group of light-emitting elements being formed by more than one luma-chroma sub-group of light-emitting elements wherein each luma-chroma sub-group in a full-color group comprises a spatial arrangement of at least two light-emitting elements, wherein the display has a peak white luminance and each luma-chroma sub-group comprises at least one distinct high-luminance light-emitting element having a peak output luminance value that is 40 percent or greater of the peak white luminance of the display device and at least one distinct low-luminance light-emitting element having a peak output luminance value that is less than 40 percent of the peak white luminance of the display device, the method comprising:

a) receiving a three-or-more color input image signal, the three-or-more color image signal specifying three-or-more color image values at each of a two-dimensional number of sampled addressable spatial locations within an image to be displayed;

b) analyzing the spatial content of the three-or-more color input image signal and the display array repeating pattern;

c) dynamically forming re-sampling functions for image spatial locations derived from the input image signal that:

i) correspond to the known spatial location of each luma-chroma sub-group in the display array;

ii) are dependent upon the similarity of the three-or-more color input values at two or more neighboring spatial locations of the image input signal;

iii) are based on an analysis of the spatial content of the three-or-more color input image signal and the display array repeating pattern wherein the analysis comprises a thresholding of a calculation of an absolute difference between a luminance value for a spatial location to be rendered to a corresponding luma-chroma sub-group and the luminance values of the two or more neighboring spatial locations of the image input signal; and iv) are implemented by convolving highly non-symmetrical kernels with the input image signal wherein the kernels are dynamically formed matrices based on the spatial content of the input image signal by assigning a first weighting value to a center element of the kernel, assigning a second value to the remaining elements of the kernel for which the corresponding three-or-more color input image signal has a similarity to the three-or-more color image signal corresponding to the center element of the kernel, and assigning a third value to the remaining elements of the kernel, wherein the second kernel value is substantially larger than the third kernel value;

d) applying the re-sampling functions to the three-or-more color input image signal to render a signal for driving each light-emitting element within each corresponding luma-chroma sub-group of light-emitting elements and driving the light-emitting elements according to the rendered signal.

14. The method according to claim 13, additionally comprising the step of transforming the three-or-more color input image signal to an alternate color space.

15. The method according to claim 14, wherein the step of transforming the three-or-more color input image signal to an alternate color space includes transforming a three color input image signal to a four-or-more color input image signal.

16. The method according to claim 14, wherein the step of transforming the three-or-more color input image signal to an alternate color space includes transforming a three-or-more color image input signal into a luminance channel and two chrominance channels.

17. The method according to claim 16, additionally comprising the step wherein the spatial resolution of the chrominance information in the input image signal is reduced, such that all light-emitting elements are employed to render high contrast edges.

18. The method according to claim 13, wherein the step of dynamically forming re-sampling functions employs a convolution kernel, wherein at least one element of the convolution kernel is dependent upon the relative color values of the three-or-more color input image signal at a plurality of neighboring spatial locations.

* * * * *